US006388395B1

(12) United States Patent
Aendekerk

(10) Patent No.: US 6,388,395 B1
(45) Date of Patent: May 14, 2002

(54) CIRCUIT DEVICE

(75) Inventor: Everaard Marie Jozef Aendekerk, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/671,984

(22) Filed: Sep. 28, 2000

(30) Foreign Application Priority Data

Sep. 30, 1999 (EP) ..... 99203200

(51) Int. Cl.[7] ..... H05B 37/02

(52) U.S. Cl. ..... 315/291; 315/224; 315/247; 315/DIG. 5

(58) Field of Search ..... 315/247, 254, 315/255, 256, 291, 209 R, DIG. 7, 307, DIG. 5, 224

(56) References Cited

U.S. PATENT DOCUMENTS

| | | | | | |
|---|---|---|---|---|---|
| 5,223,767 | A | * | 6/1993 | Kulka | 315/209 R |
| 5,412,287 | A | * | 5/1995 | Shackle | 315/247 |
| 5,502,635 | A | * | 3/1996 | Bobel | 363/132 |
| 5,521,467 | A | * | 5/1996 | Statnic et al. | 315/247 |
| 5,801,491 | A | * | 9/1998 | Canova | 315/224 |

FOREIGN PATENT DOCUMENTS

| | | | |
|---|---|---|---|
| WO | WO9719578 | 5/1997 | H05B/41/29 |

* cited by examiner

*Primary Examiner*—Don Wong
*Assistant Examiner*—Ephrem Alemu

(57) ABSTRACT

A circuit arrangement for operating a lamp has two power feedback loops, and a transformer is incorporated in one of the feedback loops. The transformer is used to adapt the amount of power fed back to the amplitude of the mains supply voltage for different lamp voltages.

6 Claims, 1 Drawing Sheet

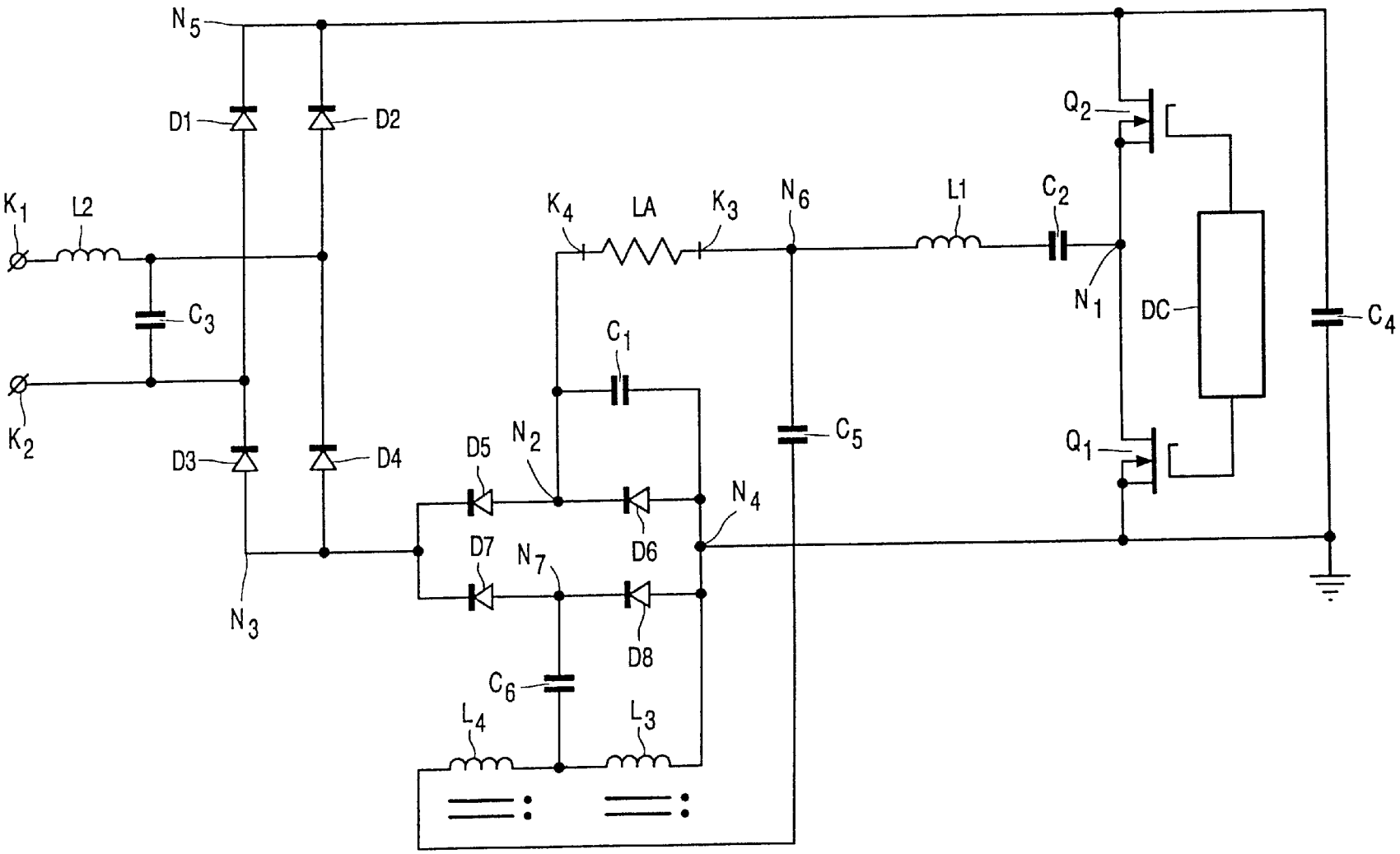
C4
DC
Q2
N1
Q1
C2
L1
C5
N6
K3
N4
LA
C1
D6
D8
L3
K4
N2
N7
C6
D5
D7
L4
D2
D4
N5
D1
D3
N3
C3
L2
K1
K2

CIRCUIT DEVICE

BACKGROUND OF THE INVENTION

The invention relates to a circuit device for operating a discharge lamp by means of a high-frequency current, which circuit device comprises input terminals for connecting it to a low-frequency supply voltage source, rectifier means coupled to the input terminals for rectifying the low-frequency supply voltage, a first circuit coupled to a first output terminal N3 of the rectifier means and to a second output terminal N5 of the rectifier means, which first circuit comprises a series arrangement of first unidirectional means, second unidirectional means and first capacitive means, which circuit device further comprises inverter means connected in parallel with the first capacitive means for generating the high-frequency current, a load circuit comprising a series arrangement of inductive means, second capacitive means and means for applying a voltage to the discharge lamp, which load circuit couples a terminal N1 of the inverter means to a terminal N2 between the first unidirectional means and the second unidirectional means, and a second circuit coupling a terminal N2 to a terminal N4 and comprising third capacitive means, a third circuit coupling the first output terminal N3 of the rectifier means to a terminal N4 between the second unidirectional means and the first capacitive means, which third circuit comprises a series arrangement of third unidirectional means and fourth unidirectional means, neither said first circuit nor said third circuit comprising inductive means, and a fourth circuit coupling the third circuit to a terminal N6, which forms part of the load circuit.

Such a circuit device is known from WO 97/19578.

The known circuit device has an optimum operating point at a load voltage which is approximately half the low-frequency supply voltage. In the case of sub-optimal discharge lamps, the arc voltage must be adapted. For this purpose, use can be made of a capacitive voltage divider; in addition to a capacitor coupling the terminal N4 to a terminal N7 between the third unidirectional means and the fourth unidirectional means, a capacitor coupling together the terminals N4 and N7. The use of capacitive voltage division, however, causes high currents in the inductive means of the load circuit and in the inverter means, particularly the switching elements of the latter. This is problematic, in particular, in the case of circuits having an electric power in excess of 100 W, since it requires additional cooling of the switching elements.

SUMMARY OF THE INVENTION

It is an object of the invention to provide a more efficient method of adapting the power feedback source to the low-frequency supply voltage.

To achieve this, the invention provides a circuit device of the type mentioned in the opening paragraph, which is characterized in that the circuit device comprises a fifth circuit by means of which the fourth circuit couples the third circuit to a terminal N6, said fifth circuit comprising transformer means which couple the terminal N4 to the fourth circuit, and a branch of which is coupled to a terminal N7 between the third unidirectional means and the fourth unidirectional means.

In accordance with the present invention, preferably the fifth circuit comprises fifth capacitive means coupling the branch of the transformer means to terminal N7 to make sure that a direct current leading to saturation of the transformer means does not flow through the transformer means and the fourth unidirectional means.

BRIEF DESCRIPTION OF THE DRAWING

An embodiment of the invention will be explained in more detail with reference to the drawing wherein the sole FIGURE shows a simplified diagrammatic view of the embodiment of a circuit device in accordance with the present invention, wherein a discharge lamp LA is coupled to the circuit device.

DESCRIPTION OF THE PREFERRED EMBODIMENT

In FIG. 1, K1 and K2 represent input terminals for making a connection with a low-frequency supply voltage source. L2 is an inductor which forms an input filter jointly with capacitor C3. Diodes D1–D4 are rectifier means for rectifying the low-frequency supply voltage. Diodes D5 and D6 form, respectively, first and second unidirectional means. Capacitor C4 forms first capacitive means and, jointly with diodes D5 and D6, a first circuit. Switching elements Q1 and Q2 and control circuit DC jointly form inverter means. The control circuit DC is a circuit part which is used to generate control signals for making switching elements Q1 and Q2 conductive and non-conductive. Inductor L1, capacitor C2 and terminals K3 and K4 for connecting a discharge lamp jointly form a load circuit. Inductor L1 forms inductive means, capacitor C2 forms second capacitive means, and terminals K3 and K4 for establishing a connection with a discharge lamp form means for applying a voltage to the discharge lamp. Capacitor C1 forms third capacitive means. Capacitor C1 and capacitor C4 jointly form a second circuit. Diodes D7 and D8 form, respectively, third and fourth unidirectional means. The series arrangement of diodes D7 and D8 forms a third circuit. Capacitor C5 forms fourth capacitive means as well as a fourth circuit.

Input terminals K1 and K2 are interconnected by means of a series arrangement of inductor L2 and capacitor C3. A first side of capacitor C3 is coupled to a first input terminal of the rectifier bridge, and a second side of capacitor C3 is coupled to a second input terminal of the rectifier bridge. A first output terminal N3 of the rectifier bridge is coupled to a second output terminal N5 of the rectifier bridge by means of a series arrangement of diode D5, diode D6 and capacitor C4. N2 is a common terminal of diode D5 and diode D6. N4 is a common terminal of diode D6 and capacitor C4. Terminal N2 is coupled to terminal N4 by means of capacitor C1. A series arrangement of diodes D7 and D8 is connected in parallel with the series arrangement of diodes D5 and D6. N7 is a common terminal of diodes D7 and D8. A series arrangement of switching elements Q1 and Q2 is connected in parallel with capacitor C4. A control electrode of switching element Q1 is coupled to a first output terminal of control circuit DC. A control electrode of switching element Q2 is coupled to a second output terminal of control circuit DC. N1 is a common terminal of switching element Q1 and switching element Q2. Terminal N1 is coupled to terminal N2 by means of a series connection of, respectively, capacitor C2, inductor L1, terminal K3, discharge lamp LA and terminal K4. N6 is a common terminal of inductor L1 and terminal K3. Terminal N6 is coupled to terminal N7 by means of capacitor C5.

If capacitor C5 directly connects terminal N6 to terminal N7, then the operation of the hitherto described part of the circuit device shown in FIG. 1 is as follows.

If input terminals K1 and K2 are connected to the poles of a low-frequency supply voltage source, then the rectifier bridge rectifies the low-frequency supply voltage supplied by this source, so that a DC voltage is applied across a capacitor C4 which serves as a buffer capacitor. The control circuit DC renders the switching elements Q1 and Q2 alternately conducting and non-conducting, and, as a result thereof, a substantially square-wave voltage having an amplitude which is approximately equal to the amplitude of the DC voltage across capacitor C4 is present on terminal N1. The substantially square-wave voltage present on terminal N1 causes an alternating current to flow through inductor L1 and capacitor C2. A first part of this alternating current flows through terminals K3 and K4, the discharge lamp LA and terminal N2. The remaining part of this alternating current flows through capacitor C5 and terminal N7. As a result, voltages having the same frequency as the substantially square-wave voltage are applied to terminal N2 as well as terminal N7. These voltages applied to terminal N2 and terminal N7 make sure that a pulsating current is drawn from the supply voltage source, also if the current across the capacitor C4 is higher than the instantaneous amplitude of the rectified low-frequency supply voltage. For this reason, the power factor of the circuit device has a comparatively high value and the total harmonic distortion of the supply current is comparatively low.

It is to be noted that similar results were achieved with a configuration of the circuit device which slightly differs from the configuration shown in FIG. 1 in that capacitor C1 couples terminal N2 to terminal N5 instead of to terminal N4. In this slightly different configuration, the capacitor C1 forms third capacitive means and a second circuit.

Hitherto, the circuit device and the operation thereof are conventional and known from WO 97/19578.

Instead of being directly coupled to terminal N7, as in the conventional circuit device, capacitor C5 is coupled, as is shown in FIG. 1, to terminal N7 via a transformer which, as shown, is preferably an autotransformer L3, L4 and, preferably, capacitor C6. Autotransformer L3, L4 forms transformer means and, in this case in combination with capacitor 6, a fifth circuit. Capacitor C6 forms fifth capacitive means. The fourth circuit couples the third circuit to terminal N6 be means of the fifth circuit. Autotransformer L3, L4 couples terminal N4 to the fourth circuit, and a branch of the autotransformer L3, L4 is coupled to terminal N7, preferably by means of capacitor C6. The fifth circuit then comprises fifth capacitive means coupling the branch of the transformer means to terminal N7.

Said circuit device has an optimum operating point at a load voltage which is approximately equal to half the low-frequency supply voltage. The autotransformer L3, L4 is used for adapting to the arc voltage of sub-optimal discharge lamps. This measure enables the power feedback source to be more efficiently adapted to the low-frequency supply voltage than, for example, a capacitive voltage divider whose main drawback resides in a high current in inductor L2 and in the switching elements Q1 and Q2, particularly, in circuits operating at an electric power above 100 W, which require additional cooling of the circuit elements.

Capacitor C6 is preferably used to block the flow of direct current in order to preclude saturation of the autotransformer L3, L4.

What is claimed is:

1. A circuit device for operating a discharge lamp by means of a high-frequency current, said circuit device comprising:

a. input terminals for connecting said device to a low-frequency supply voltage source and rectifier means coupled to the input terminals for rectifying the low-frequency supply voltage;

b. a first circuit coupled to a first output terminal N3 of the rectifier means and to a second output terminal N5 of the rectifier means, said first circuit comprising a series arrangement of first unidirectional means, second unidirectional means and first capacitive means;

c. an inverter connected in parallel with the first capacitive means for generating the high-frequency current, d. a load circuit comprising a series arrangement of inductive means, second capacitive means and means for applying a voltage to the discharge lamp, said load circuit coupling a terminal N1 of the inverter to a terminal N2 between the first unidirectional means and the second unidirectional means;

e. a second circuit coupling the terminal N2 to a terminal (N4) between the second unidirectional means and the first capacitive means and comprising third capacitive means;

f. a third circuit coupling the first output terminal N3 of the rectifier means to the terminal N4, said third circuit comprising a series arrangement of third unidirectional means and fourth unidirectional means;

g. a fourth circuit coupling the third circuit to a terminal N6, which forms part of the load circuit;

h. a fifth circuit by means of which the fourth circuit couples the third circuit to the terminal N6, said fifth circuit comprising a transformer for coupling the terminal N4 to the fourth circuit, said transformer having a tap coupled to a terminal N7 between the third unidirectional means and the fourth unidirectional means.

2. A circuit device as claimed in claim 1, characterized in that the fifth circuit comprises fifth capacitive means coupling the branch of the transformer to terminal N7.

3. A circuit device as claimed in claim 1, characterized in that the second circuit comprises the first capacitive means.

4. A circuit device as claimed in claim 1, characterized in that the fourth circuit comprises fourth capacitive means.

5. A circuit device as claimed in claim 1, characterized in that the unidirectional means comprise diode means.

6. A circuit device as claimed in claim 1, characterized in that the inverter comprises a series arrangement of a first switching element, terminal N1 and a second switching element, as well as a control circuit (DC), which is coupled to the switching elements and which serves to generate a control signal for rendering the switching elements alternately conducting and non-conducting.

* * * * *